US006173696B1

(12) United States Patent
Fett et al.

(10) Patent No.: US 6,173,696 B1
(45) Date of Patent: Jan. 16, 2001

(54) VIRTUAL POWER STEERING SWITCH

(75) Inventors: Dennis W. Fett, Clinton Township; Joseph B. Adams, Northville; Benjamin D. Ellies, Ann Arbor, all of MI (US)

(73) Assignee: DaimlerChrysler Corporation, Auburn Hills, MI (US)

( * ) Notice: Under 35 U.S.C. 154(b), the term of this patent shall be extended for 0 days.

(21) Appl. No.: 09/213,975

(22) Filed: Dec. 17, 1998

(51) Int. Cl.[7] ..... F02D 41/08

(52) U.S. Cl. ..... 123/339.17; 123/339.18; 123/339.21; 123/339.23

(58) Field of Search ..... 123/361, 339.18, 123/339.19, 339.23, 339.21, 339.16, 339.17

(56) References Cited

U.S. PATENT DOCUMENTS

| | | | | |
|---|---|---|---|---|
| 4,354,466 | | 10/1982 | Dudley et al. . | |
| 4,386,591 | | 6/1983 | Nagase et al. . | |
| 4,475,504 | | 10/1984 | Mizuno . | |
| 4,479,472 | * | 10/1984 | Shimamura | 123/339.18 |
| 4,491,108 | * | 1/1985 | Hasegawa et al. | 123/339.18 |
| 4,492,195 | | 1/1985 | Takahashi et al. . | |
| 4,697,562 | | 10/1987 | Boccadoro et al. . | |
| 4,721,083 | * | 1/1988 | Hosaka | 123/339.18 |
| 4,748,951 | | 6/1988 | Manaka et al. . | |
| 5,035,215 | * | 7/1991 | Ohuchi | 123/339.18 |
| 5,365,917 | | 11/1994 | Adams et al. . | |
| 5,435,285 | | 7/1995 | Adams et al. . | |
| 5,492,102 | | 2/1996 | Thomas et al. . | |
| 5,520,162 | | 5/1996 | Rotramel et al. . | |
| 5,562,808 | | 10/1996 | Sachdeva et al. . | |
| 5,666,917 | | 9/1997 | Fraser et al. . | |
| 5,975,049 | * | 11/1999 | Kawasaki | 123/399.18 |
| 6,009,852 | * | 1/2000 | Akabori et al. | 123/339.19 |

FOREIGN PATENT DOCUMENTS

| | | | | |
|---|---|---|---|---|
| 61-75061 | * | 4/1986 | (JP) | 701/110 |
| 6-17691 | * | 1/1994 | (JP) | 123/339.18 |

* cited by examiner

*Primary Examiner*—Erick Solis
(74) *Attorney, Agent, or Firm*—Ronald A. Fuller, III

(57) ABSTRACT

A computer-implemented apparatus and method for inferring power steering load and for controlling airflow to an engine of a vehicle having an engine speed. A sensor which is connected to the engine senses the engine speed of the engine. An engine speed reference data table stores at least one engine reference speed, and a reference comparator module which is connected to the sensor and to the reference data table performs a comparison between the sensed engine speed and the engine reference speed. The airflow to the engine is controlled based upon the comparison.

19 Claims, 7 Drawing Sheets

VIRTUAL POWER STEERING SWITCH

BACKGROUND OF THE INVENTION

1. Technical Field

The present invention relates generally to internal combustion engines and, more particularly, to an vehicle engine airflow compensation.

2. Discussion

A vehicle's engine experiences many loads upon itself which reduces the engine's torque output. Engine loads include activation of a power steering pump to provide power steering capability when a driver is using the vehicle's steering wheel.

Assistance for the engine in handling loads exists in the way of increasing the airflow to the engine. Current approaches for compensating airflow to an engine experiencing parasitic loads include using a physical component known as a pressure switch. The pressure switch is mounted directly in the power steering pump to indirectly sense a load on the engine.

When the pressure exceeds 400 psi fluid pressure in the pump following a steering maneuver, the physical switch activates and sets a software bit. The bit triggers an Intake Airflow Control Valve (IACV) in order to compensate for the power steering induced load on the engine at idle conditions. When fluid pressure recedes back to a predetermined set point as steering effort is reduced or stopped, the IACV resets the bit to zero. The physical component pressure switch approach suffers from such disadvantages as, but not limited to, the failure rates associated with physical components as well as the cost in order to manufacture and install a physical component in a vehicle.

SUMMARY OF THE INVENTION

The present invention overcomes the aforementioned disadvantages as well as other disadvantages. In accordance with the teachings of the present invention, a computer-implemented apparatus and method is provided for controlling airflow to an engine of a vehicle having an engine speed. A sensor which is connected to the engine senses the engine speed of the engine. An engine speed reference data table stores at least one engine reference speed, and a reference comparator module which is connected to the sensor and to the reference data table performs a comparison between the sensed engine speed and the engine reference speed. The airflow to the engine is controlled based upon the comparison.

BRIEF DESCRIPTION OF THE DRAWINGS

Additional advantages and features of the present invention will become apparent from the subsequent description and the appended claims taken in conjunction with the accompanying drawings wherein the same referenced numeral indicates the same components:

DETAILED DESCRIPTION OF THE PREFERRED EMBODIMENT

Figure 1:
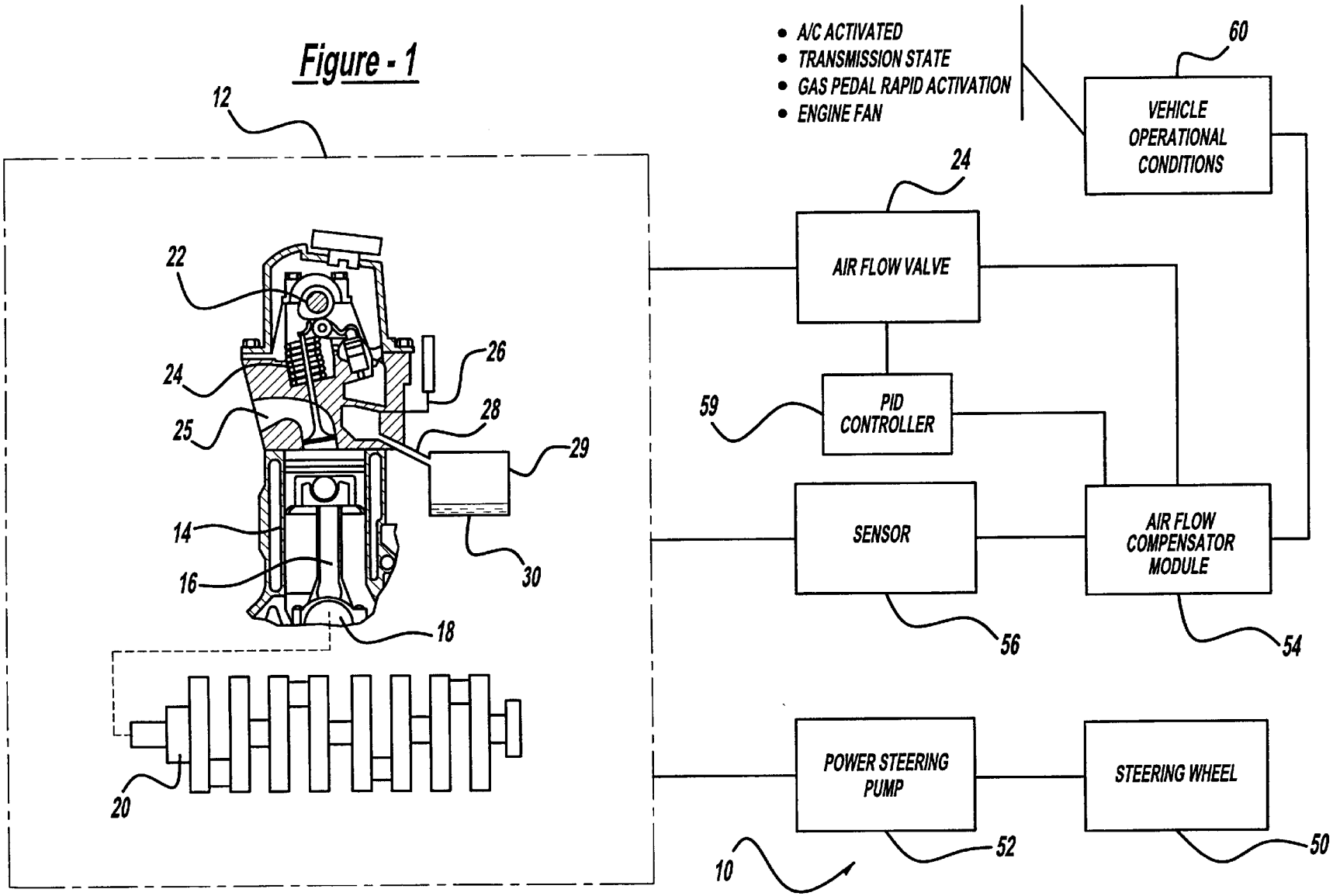
FIG. 1 is a system block diagram depicting the airflow compensator module of the present invention within a vehicle's environment.

With reference to FIG. 1, a block diagram of the engine system, in which an airflow compensation module of the present invention is implemented, is shown generally at 10. The system 10 includes an internal combustion spark ignited engine 12, shown in partial cross-section, which is of the type implemented in a conventional motor vehicle (not shown). Engine 12 contains a plurality of cylinders represented by cylinder 14, with each of the cylinders having a piston, represented by piston 16, operatively disposed therein. Each of the pistons is connected by a connecting rod 18 to a crankshaft 20. A conventional engine cam shaft 22 is also operatively located within engine 12 for opening and/or closing an intake valve, such as valve 24 associated with the cylinder 14 for supplying a fuel/air mixture to the cylinders in a manner well known in the art during the piston intake. A manifold 25 is also operatively associated with the intake valve 24 for supplying air from outside of the engine into the cylinder 14 to provide air for the valve fuel/air mixture supply to the cylinder.

Engine 12 includes an intake stroke in which fuel and air mixture is input into the cylinder 14 through the intake valve 24, a compression stroke in which the fuel/air mixture is compressed by the piston 16, an expansion stroke in which a spark supplied by a spark plug 26 ignites the fuel/air mixture, an exhaust stroke during which gases from the burned fuel are exhausted from the cylinder through an exhaust system 28, which includes a catalytic converter 29 having an associated catalyst 30.

The preferred embodiment of the present invention is implemented in an six cylinder, four-stroke engine, but may also be implemented in a four cylinder, four-stroke engine. Moreover, it should be appreciated that the present invention may be implemented in any conventional engine system, including a two-stroke engine system or any spark ignited or diesel engine system.

Engine 12 experiences during its operation various loads which reduce its revolutions per minute (RPM) output. For example, operation of the vehicle steering wheel 50 activates a power steering pump 52 in order to assist the vehicle's driver in performing a steering operation. Activation of power steering pump 52 is a parasitic load upon engine 12 which acts parasitically to lower the RPM output of engine 12.

The present invention's airflow compensator module 54 utilizes sensor 56 in order to sense the lower RPM output of engine 12 due to activation of power steering pump 52. In this preferred embodiment, sensor 56 is airflow compensator module 54 which is a software-based executable program which provides opening and closing control signals to airflow valve 24 based upon comparisons of the sensed engine RPM output and various reference and threshold data tables stored within airflow compensator module 54.

Since the present invention utilizes an airflow compensator module 54 which is software-based, the present invention includes more sophisticated functionality than conventional approaches which use pressure switch physical components. Accordingly, airflow compensator module 54 is able to detect other vehicle operating conditions 60 and perform different functions to suit different applications. For example, but not limited to, different vehicle operational conditions 60 include: whether the air conditioning has been activated; what the transmission state of the vehicle is (e.g., whether the vehicle's engine is in a park state or a driving state); and whether the engine fan is activated in order to cool the engine. Based upon the specific needs of the application at hand, the present invention can be set to ignore the loads imposed by vehicle operational conditions 60 and operate airflow valve 24 only upon activation of power steering pump 52. Airflow compensation module 54 can be set to also detect one or more of the vehicle operational conditions 60 in order to adjust airflow valve 24 to provide more airflow to engine 12. Whether airflow compensator module 54 is to adjust airflow valve 24 based upon vehicle operational conditions 60, depends upon if devices already exist within the vehicle for adjusting airflow valve 24. Controller 59 which utilizes a proportional-integral-derivative (PID) control approach uses the data generated from the air flow compensator module 54 in order to update its own control algorithm in controlling air flow valve 24.

Figure 2:
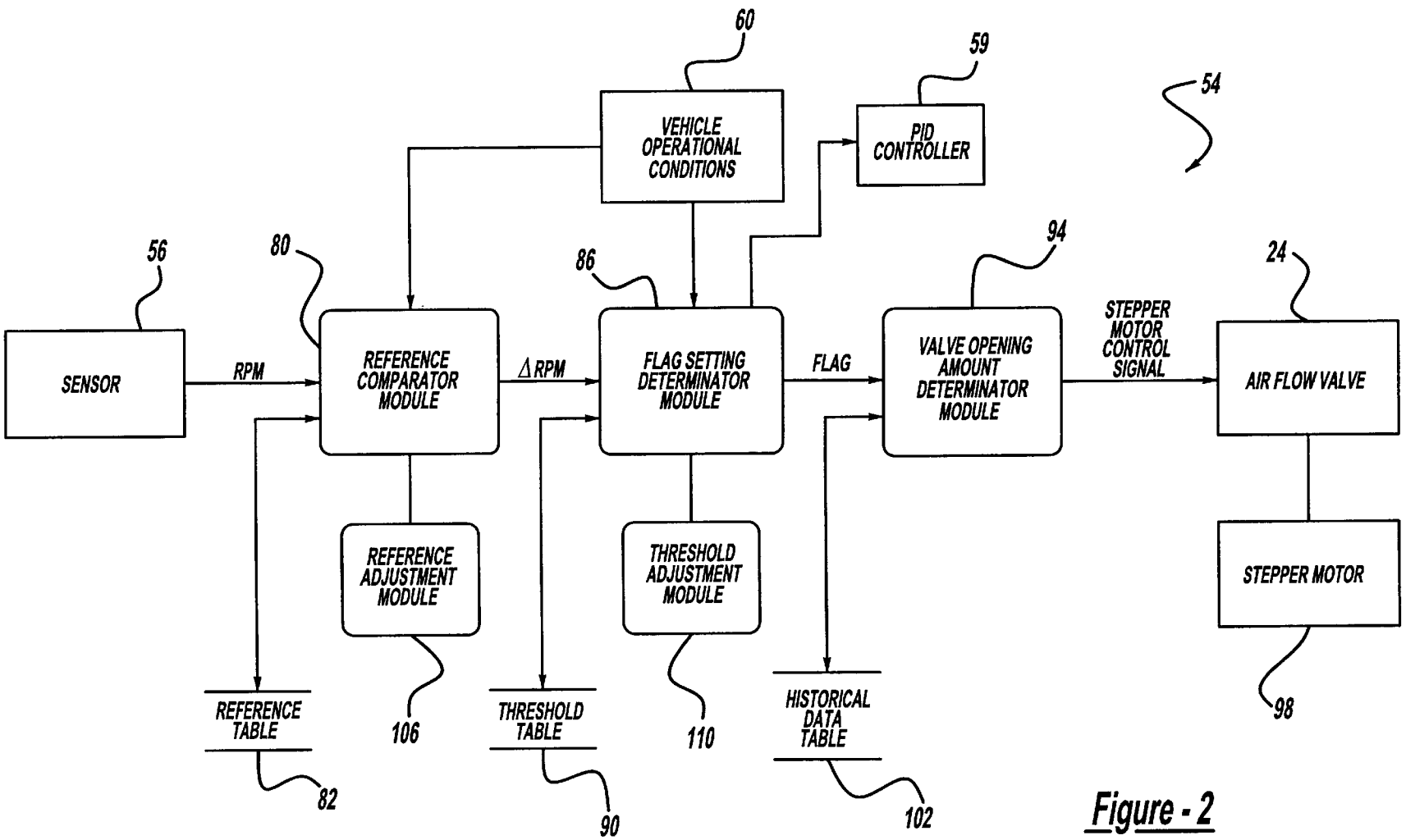
FIG. 2 is a block diagram depicting the components involved within the present invention for performing airflow compensation.

FIG. 2 is a block diagram which depicts the software-based components of airflow compensator module 54. Airflow compensator module 54 includes a reference comparator module 80 which compares the engine RPM value from sensor 56 with RPM reference values stored in reference table 82. Reference comparator module 80 utilizes different reference values from reference table 82 based upon different vehicle operational conditions 60. For example, but not limited to, reference comparator module 80 utilizes one reference value when the vehicle is in an engine park state and a second reference value when the vehicle is in a drive state.

Reference comparator module 80 selects the appropriate reference value from reference table 82 and calculates the difference between the selected reference RPM value and the RPM value from sensor 56. Reference comparator module 80 provides the ΔRPM value to flag setting determinator module 86.

Flag setting determinator module 86 compares the ΔRPM value with threshold values stored in threshold table 90. If the ΔRPM value satisfies the selected threshold value, then flag setting determinator module 86 provides a flag (or a software bit value) to valve opening determinator module 94.

Valve opening determinator module 94 determines the amount of the valve opening for airflow valve 24 so that additional airflow may be provided to the engine while the power steering pump is operating. Valve opening determinator module 94 more particularly provides control signals to the stepper motor 98 of airflow valve 24 in order to indicate how much the airflow valve 24 should be opened.

Valve opening determinator module 94 utilizes historic RPM data stored in historic data table 102. In the preferred embodiment of the present invention, valve opening determinator module 94 utilizes the ΔRPM values as gathered over a predetermined amount of time. Preferably, the predetermined amount of time includes the ΔRPM values gathered up to the preceding three seconds or a time factor suitable for the situation at hand.

Due to the various vehicle operational conditions 60, reference comparator module 80 and flag setting determinator module 86 include modules to adjust the reference and threshold values stored respectively in the data tables 82 and 90. For example, when the vehicle's air conditioning system is activated, reference adjustment module 106 of reference comparator module 80 lowers the normally used reference value stored in reference table 82 by a predetermined amount.

The following table provides reference and threshold values for various engine operating conditions used within the preferred embodiment of the present invention.

| | Park/ Neutral | Drive (High) | Drive (low) | Offset Due To A/C | Offset Due To Fan |
|---|---|---|---|---|---|
| Reference Idle Speed | 728 | 650 | 543 | — | — |
| Δ Threshold | 80 | 75 | 30 | −100 | −10 |
| Absolute RPM to Trigger PID Idle RPM Offset | 478 | — | — | — | — |

The reference values are selected according to the present requirements of the situation. Chiefly, the threshold and offset values are selected which optimize steering sensitivity and fuel economy, but can include optimization of other factors related to vehicle performance.

Figure 4:
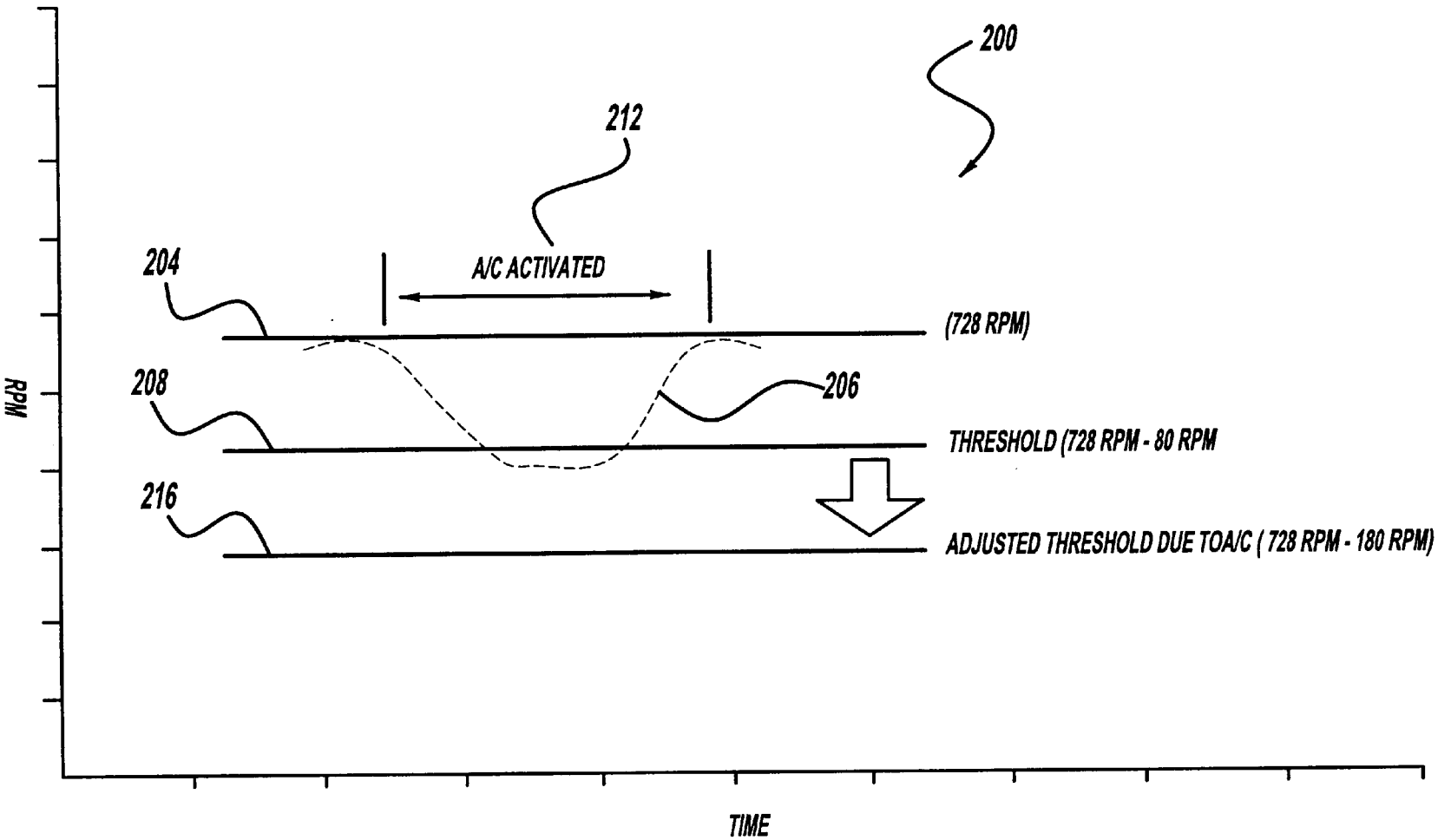
FIG. 4 is an x-y graph depicting the operation of the present invention for airflow compensation due to air conditioning activation.

FIG. 4 depicts an example of the lowering of a reference value upon activation of the vehicle's air conditioning system. Graph 200 depicts the engine speed (RPM) as the ordinate axis versus time as the abscissa axis. Level 204 is the normal operating RPM level of the engine. If the lowering of engine speed profile 206 below threshold level 208 is due to the activation of the power steering pump, then the present invention is activated in order to provide airflow compensation. However, if the lowering of the engine speed profile 206 is due to the air conditioning system being activated, then the threshold level is lowered to threshold level 216 for the duration 212 in which the air conditioning system is activated.

Figure 5:
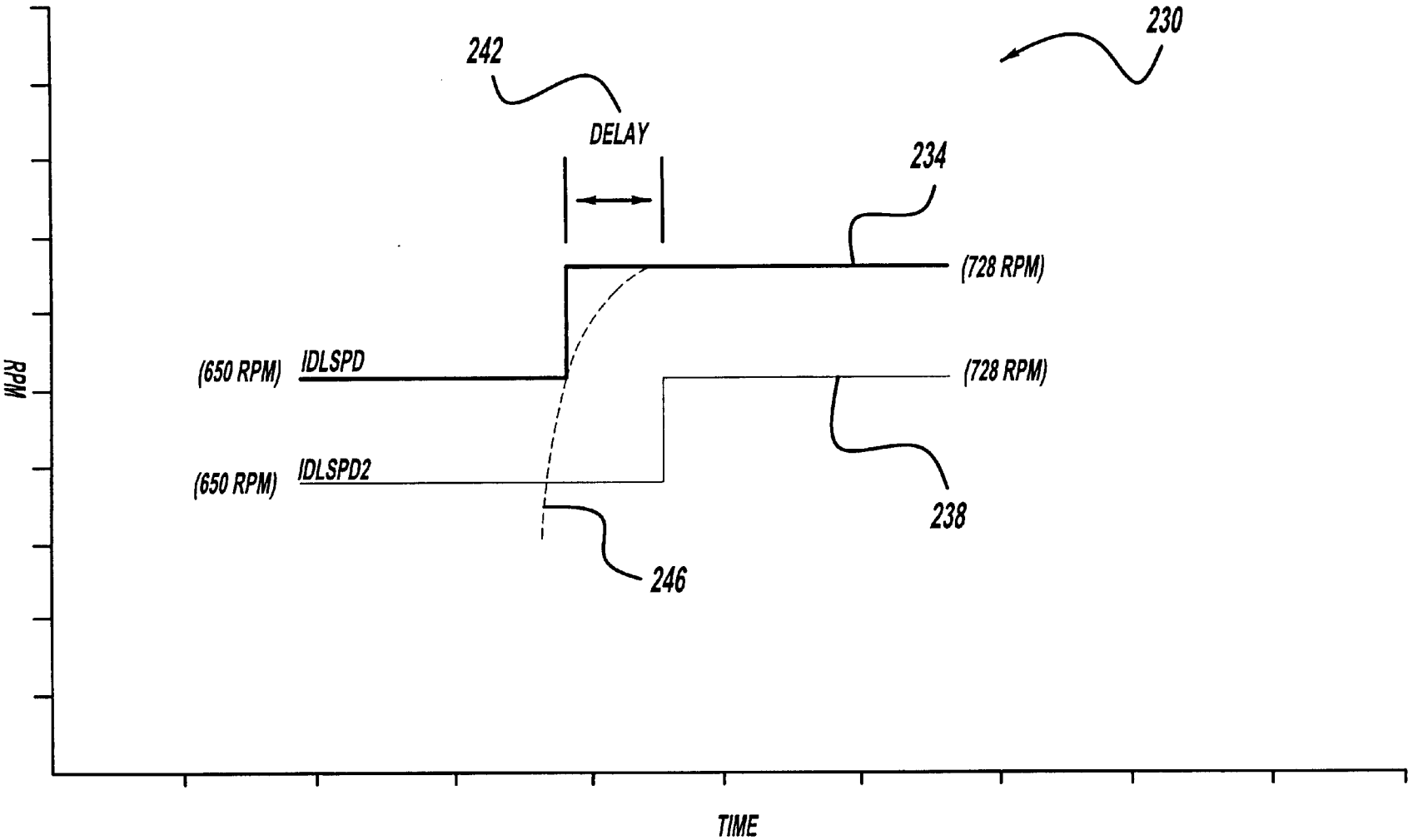
FIG. 5 is an x-y graph depicting the operation of the present invention when a transmission change has occurred.

FIG. 5 depicts an example of the delaying application of reference and threshold comparison by the present invention due to a change in transmission state. Graph 230 depicts the engine speed (RPM) as the ordinate axis versus time as the abscissa axis. RPM reference levels 238 and 234 depict the heightening of the reference value due to a transmission change from, for example, a driving idle state to a non-driving idle state. The present invention utilizes a delay 242 in order to delay application of the new heightened reference level.

With reference back to FIG. 2, reference and threshold adjustment modules 106 and 110 implement the threshold lowering functionality as depicted in FIG. 4 as well as the delaying functionality as depicted in FIG. 5.

Figure 3:
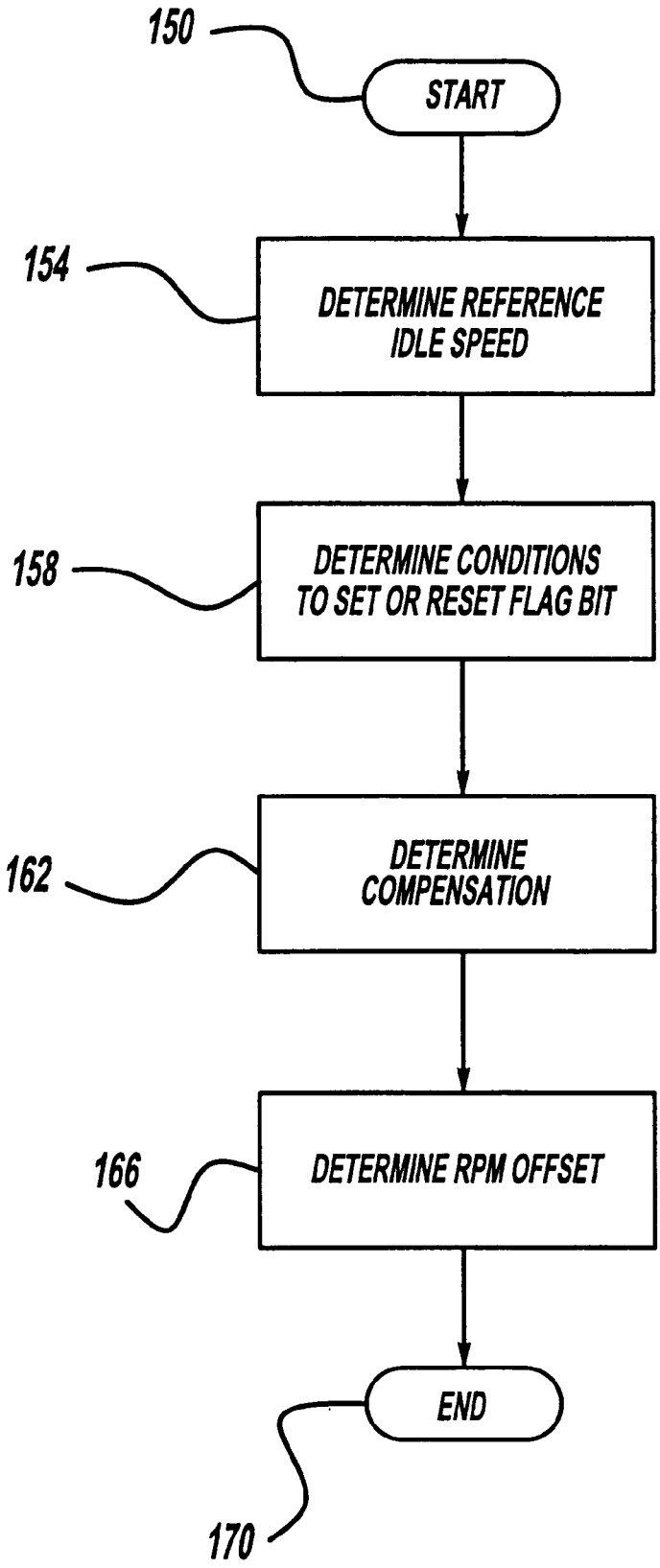
FIG. 3 is a flowchart depicting the operational steps utilized by the present invention for determining airflow compensation.

FIG. 3 depicts a flowchart of the processing steps of the present invention. The processing steps discussed in conjunction with FIG. 3 utilize the following variables:

VPSS: Virtual Power Steering switch.

DLRPM2: Delta RPM.

IDLSP2: Reference RPM for VPSS.

PSSTMR: Delay between exceeding LRPMz and setting VPSS bit.

INCTMR: Timer used for decrementing RPM during transition to VIS low idle speed.

SRTIMR: VPSS disable timer after start-up.

ACFTMR: Timer to add fan initiated offset to $LRPM_z$.

VTIMER: Timer to delay IDLSP2 update when stepping out of VIS.

VIS: Variable idle speed mode.

DRTIMR: Timer to delay IDLSP2 update during a d/r to p/n gear transition (where d/r represents drive/reverse and p/n represents park/neutral).

DLRTMR: PNIDEL RPM offset timer.

ACTMR: Timer to add A/C initiated offset to $LRPM_z$.

The processing steps discussed in conjunction with FIG. 3 utilize the following constants:

LRPMz: DLRPM2 threshold (z denotes idle mode).

VIS2z: VPSS reset RPM threshold (z denotes idle mode).

OFFSET: RPM decrement amount during transition to VIS low speed.

LMTRP0: Offset to LRPMZ while fan offset timer ACFTMR is active.

PSSTIM: Delay between exceeding LRPMz and setting VPSS bit.

INCTIM: Loop time used for decrementing RPM during transition to VIS low idle speed.

SRDELY: VPSS disable time after start-up.

IDLSPD: Idle speed of the engine.

MFRPM0: Instantaneous RPM (i.e., sensed RPM).

BARAPS: Power steering barometric adjustment factor.

PSRPML: Power steering RPM limit.

CLTEMP: Engine coolant temperature.

PSTEMP: Power steering engine coolant temperature limit.

DECEL: Sensed deceleration of the vehicle.

IDLDEL: Start-up delta Idle RPM.

ACFDLO: Timer limit to add fan initiated offset LMTRPO to LRPMz.

VDELAY: Timer limit to delay IDLSP2 update when stepping out of VIS.

DRDELY: Timer limit to delay IDLSP2 update during a d/r to p/n gear transition.

PSKlz: IACV open kick tables for d/r low, d/r high and p/n (z denotes idle mode).

DLRLMT: MFRPM0 low limit threshold to trigger RPM offset PNIDEL.

PNIDEL: RPM offset table, added to target idle speed, when MFRPM0 exceeds DLRLMT in p/n.

ACOFLO: Offset to LRPMLO while A/C offset timer ACTMR is active.

ACOFHI: Offset to LRPMHI while A/C offset timer ACTMR is active.

ACOFPN: Offset to LRPMPN while A/C offset timer ACTMR is active.

ACTMRL: Timer limit for ACTMR to add A/C initiated offset ACOFz.

LOWIDL: Low Idle Status Flag.

With reference to FIG. 3, start indication block 150 indicates that process block 154 is to be executed. Process block 154 determines the reference idle speed of the engine. In the preferred embodiment, process block 154 utilizes the following steps in order to determine the reference idle speed:

a) If LOWIDL=0 and VTIMER NOT ACTIVE OR DRTIMR not active IDLSP2=idlspd b) If LOWIDL=1 and IDLSP2>VIS low idle speed IDLSP2=MFRPM0–(OFFSET), WHERE OFFSET is subtracted every INCTIM, until IDLSP2=VIS low idle speed Note: MFRPM0 starts the decrement from the current engine speed when the LOWIDL flag is first set c) If VTIMER is activated, then IDLSP2 is held at the previous low idle speed until VTIMER=VDELAY d) If DRTIMR is activated, then IDLSP2 is held at the previous level until DRTIMR=DRDELY Process block 158 determines the conditions as to whether to set or reset the flag bit. In the preferred embodiment, process block 158 utilizes the following steps:

a) If DLRPM2>=LRPMz+(LMTRP0 or $ACOF_z$ if applicable) and VPSS 0, then increment PSSTMR, else PSSTMR=0 b) If PSSTMR=PSSTIM, then VPSS=1 (i.e., to set VPSS, DLRPM2 has to be greater than Mz for PSSTIM time).

c) Inhibit setting VPSS after start-up if SRDELY is active d) Inhibit VIS when VPSS is set e) Reset PSSTMR when VPSS is set To prevent setting VPSS prematurely when the fan is engaged, an offset MTRP0 is added to the LRPML0 threshold in low idle speed mode for a time period ACFDL0. This prevents VPSS from unnecessarily triggering and canceling VIS mode. Similarly, to prevent setting VPSS prematurely from A/C on or off IACV compensation, an offset $ACOF_z$ is added to $LRP_z$ for a time period ACTMRL. The offset is applied before the A/C clutch is actually engaged. Process block 158 also performs the following steps:

a) If MFRPM0>=$VIS2_z$ and VPSS=1, then Reset VPSS bit.

Process block 162 determines the compensation by calculating the power steering kick where power steering kick refers to a step increase of air flow. In the preferred embodiment, process block 162 utilizes the following steps:

If VPSS bit=1, then

Power Steering Kick=$PSKI_z$ *BARAPS when: MFRPM0<PSRPML, CLTEMP>PSTEMP, a higher priority IACV compensation is not overriding VPSS kicks, not a DECEL and not in an open to closed throttle transition.

Process block 166 determines the RPM offset by preferably performing the following steps:

If in park or neutral and

SRTIMR>=SRDELY and

CLTEMP>=PSTEMP then a) Reset DLRTMR and hold at zero until MFRPMO<DLRLMT b) Once MFRPM0<DLRLMT start to increment DLRTMR (MFRPM0 must recover above DLRLMT for timer to continue increment)

c) IDLSP2=IDLSP2+[LARGEST OF PNIDEL or IDLDEL] (Where PNIDEL is indexed by DLRTMR) else (if not in P/N or other disable condition) IDLSP2=IDLSP2+IDLDEL Processing for one iteration of the present invention terminates at end block 170.

Figure 6:
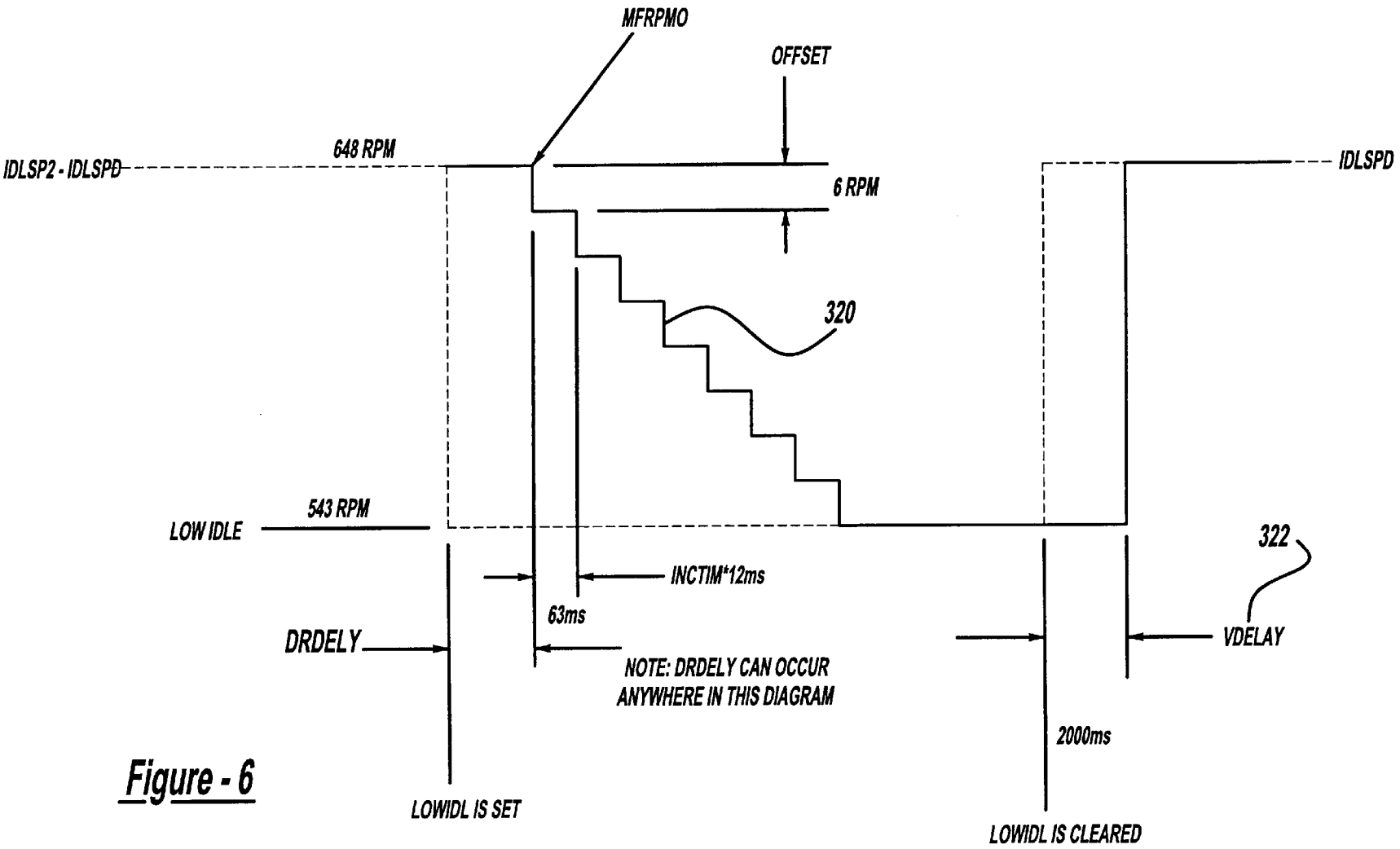
FIG. 6 is an x-y graph depicting the reference RPM ramping situation within the present invention when entering low idle speed.

FIG. 6 is an x–y graph depicting the reference RPM ramping situation within the present invention. The gradual ramping down profile 320 is caused entering into variable idle speed (VIS) mode (i.e., low idle speed). Profile 320 so that the reference RPM more closely follows the actual RPM. When the low idle flag is set, the ramp rate is preferably for every unit time there is a predetermined decrease in the reference RPM. For example, for every 63 milliseconds there is a decrease in the reference RPM of 10 RPMs. It should be understood that the present invention includes using other types of ramping functions in order to decrease the reference RPM values, such as polynomial functions which can more closely follow the actual RPM. Moreover, there is a timer limit to delay IDLSP update when stepping out of VIS as shown by reference numeral 322.

Figure 7:
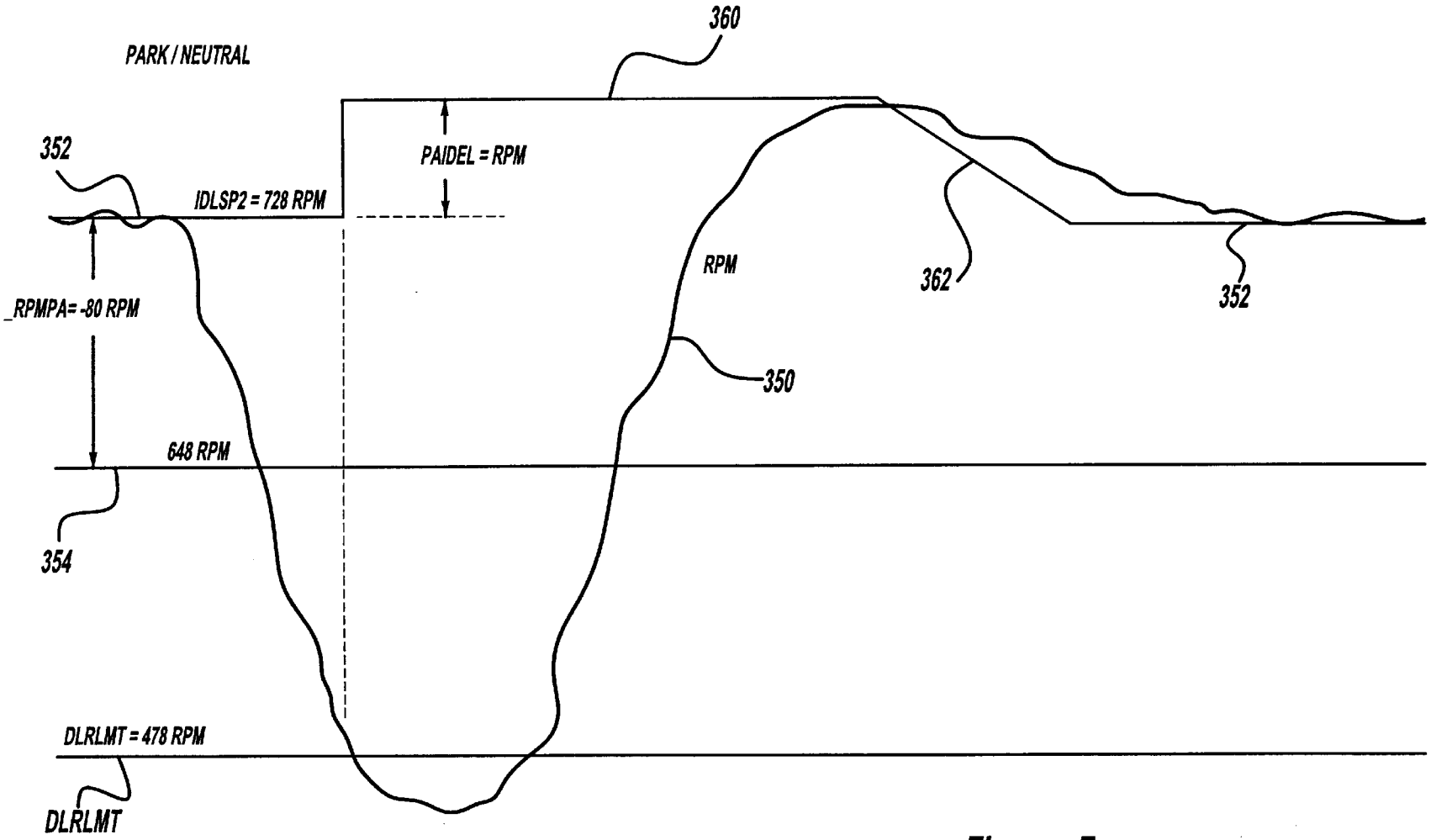
FIG. 7 is an x-y graph depicting a triggering of a PID idle response within the present invention when nearing die-out RPM levels.

FIG. 7 is an x–y graph depicting a triggering of a PID idle response within the present invention. The engine reference speed is increased based upon the sensed engine speed satisfying a predetermined lower limit. RPM trace 350 is depicted at IDLSP2 level 352 and then dropping down below the delta threshold 354 of eighty (which is 648 RPM). When RPM trace 350 drops below threshold 356 (which is DLRLMT whose value is 478 RPM), a high idle speed offset (PNIDEL) is triggered which increases by 72 RPMs the target idle speed in order to form increased target idle speed threshold 360. This approach helps to prevent stall-out from occurring since it makes it more difficult for the RPM to drop that low again. The increased target idle speed threshold 360 is used for a predetermined time as is shown by a subsequent ramping down 362 back to the original level 352. For the preferred embodiment, the ramping down period back to the original level is approximately 30 seconds.

Since preferably the vehicle's electrical system does not make coarse adjustments to electrical loads, the power steering is not compromised by activating more than one electrical load. For example, use of an alternator control system may be used to accomplish this objective.

It will be appreciated by those skilled in the art that various changes and modifications may be made to the embodiment discussed in the specification without departing from the spirit and scope of the invention as defined by the appended claims.

What is claimed:

1. A computer-implemented apparatus for controlling airflow to an engine of a vehicle having an engine speed comprising:

a sensor connected to the engine for sensing the engine speed of the engine;

an engine speed reference data table for storing first and second engine reference speeds; and a reference comparator module for selecting between the first and second engine reference speeds based upon operational state of the vehicle, said reference comparator module performing a comparison between said sensed engine speed and said selected engine reference speed wherein the comparator module does not perform the comparison using vehicle load sensed data nor using temperature sensed data;

whereby the airflow to the engine is controlled based upon said comparison.

2. The apparatus of claim 1 wherein said reference comparator module determines the difference between said sensed engine speed and said engine reference speed, said apparatus further comprising:

an engine speed threshold data table for storing at least one engine speed difference threshold;

a flag setting determinator module connected to said engine speed threshold data table and to said reference comparator module for performing a comparison between said determined difference with said stored engine speed difference threshold, whereby the airflow to the engine is controlled based upon said comparison by said flag setting determinator module.

3. The apparatus of claim 1 further comprising:

historical data storage for storing historical data related to the engine speed; and a valve opening determinator module connected to said flag setting determinator module for determining the amount of airflow to be provided to the engine.

4. The apparatus of claim 3 further comprising:

an air flow valve connected to said valve opening determinator module for controlling the amount of airflow to the engine, said valve opening determinator module providing control signals indicative of the degree of opening for said valve, said control signals being based upon the determined amount of airflow.

5. The apparatus of claim 1 further comprising:

a reference adjustment module for adjusting the reference speed based upon detection of a predetermined condition.

6. The apparatus of claim 5 wherein said predetermined condition is selected from the group consisting of air conditioning system being activated, a change in transmission state of the vehicle, activation of an engine fan, and combinations thereof.

7. The apparatus of claim 1 further comprising:

a reference adjustment module for delaying for a predetermined time said comparison by said reference comparator module between said sensed engine speed and said engine reference speed, said reference adjustment module delaying said comparison based upon detection of a predetermined condition.

8. The apparatus of claim 7 wherein said predetermined condition is a change in transmission state of the vehicle.

9. The apparatus of claim 1 wherein the value of said engine reference speed is established based upon fuel economy factors and upon steering sensitivity.

10. The apparatus of claim 1 wherein said engine reference speed is decreased in order to substantially follow said sensed engine speed.

11. The apparatus of claim 1 wherein said engine reference speed is decreased at a predetermined time unit in order to substantially follow said sensed engine speed.

12. The apparatus of claim 1 wherein said engine reference speed is increased based upon said sensed engine speed satisfying a predetermined lower limit.

13. A computer-implemented method for controlling airflow to an engine of a vehicle having an engine speed, comprising the steps of:

sensing the engine speed of the engine;

storing at least one engine reference speed;

performing a comparison between said sensed engine speed and said engine reference speed, said performing of the comparing not being based upon vehicle load sensed data nor upon temperature sensed data;

controlling the airflow to the engine based upon said comparison.

14. The method of claim 13 further comprising the steps of:

determining the difference between said sensed engine speed and said engine reference speed;

storing at least one engine speed difference threshold;

performing a comparison between said determined difference with said stored engine speed difference threshold; and controlling the airflow to the engine based upon said comparison by said flag setting determinator module.

15. The method of claim 13 further comprising the steps of:

storing historical data related to the engine speed;

and determining the amount of airflow to be provided to the engine.

16. The method of claim 13 further comprising the step of:

adjusting the reference speed based upon detection of a predetermined condition.

17. The method of claim 13 further comprising the steps of:

delaying for a predetermined time said comparison by said reference comparator module between said sensed engine speed and said engine reference speed; and delaying said comparison based upon detection of a predetermined condition.

18. The method of claim 13 further comprising the step of:

decreasing said engine reference speed in order to substantially follow said sensed engine speed.

19. The method of claim 13 further comprising the step of:

increasing said engine reference speed based upon said sensed engine speed satisfying a predetermined lower limit.

* * * * *